US009617808B2

(12) United States Patent
Liu et al.

(10) Patent No.: US 9,617,808 B2
(45) Date of Patent: Apr. 11, 2017

(54) CONTINUOUS OIL PIPE CLAMP MECHANISM

(71) Applicants: YANTAI JEREH OILFIELD SERVICES GROUP Co., Ltd., Yantai, Shandong (CN); YANTAI JEREH PETROLEUM EQUIPMENT AND TECHNOLOGIES Co., Ltd., Yantai, Shandong (CN)

(72) Inventors: Dong Liu, Yantai (CN); Qingfeng Yu, Yantai (CN); Jilei Fang, Yantai (CN)

(73) Assignees: YANTAI JEREH OILFIELD SERVICES GROUP Co., Ltd., Yantai, Shandong (CN); YANTAI JEREH PETROLEUM EQUIP. AND TECH. Co., Ltd., Yantai, Shandong (CN)

( * ) Notice: Subject to any disclaimer, the term of this patent is extended or adjusted under 35 U.S.C. 154(b) by 278 days.

(21) Appl. No.: 14/414,683

(22) PCT Filed: Nov. 29, 2012

(86) PCT No.: PCT/CN2012/085504

§ 371 (c)(1),
(2) Date: Jan. 13, 2015

(87) PCT Pub. No.: WO2014/079085

PCT Pub. Date: May 30, 2014

(65) Prior Publication Data

US 2015/0204148 A1 Jul. 23, 2015

(30) Foreign Application Priority Data

Nov. 21, 2012 (CN) ..... 2012 2 0621879 U

(51) Int. Cl.
*E21B 19/22* (2006.01)

(52) U.S. Cl.
CPC ..... *E21B 19/22* (2013.01)

(58) Field of Classification Search
CPC ..... E21B 19/22
(Continued)

(56) References Cited

U.S. PATENT DOCUMENTS 6,173,769 B1 * 1/2001 Goode ..... E21B 19/22 166/77.3
6,189,609 B1 2/2001 Shaaban et al.
(Continued)

FOREIGN PATENT DOCUMENTS

| | | |
|---|---|---|
| CN | 201297134 Y | 8/2009 |
| CN | 102140898 A | 8/2011 |
| CN | 102667185 A | 9/2012 |

*Primary Examiner* — Blake Michener
*Assistant Examiner* — Kenneth Beyers
(74) *Attorney, Agent, or Firm* — Andrew W. Chu; Craft Chu PLLC

(57) ABSTRACT

The continuous oil pipe clamp mechanism includes a saddle-shaped clamp block and a clamp block seat. The saddle-shaped clamp block is buckled on the clamp block seat. The saddle-shaped clamp block includes a saddle-shaped clamp portion and a bottom, wherein the bottom has a clamp groove, and tongue platforms are arranged at two ends of the clamp groove. The clamp block seat includes a fit portion fitted to the saddle-shaped clamp block, wherein the fit portion is provided with a sunk groove matched with the clamp groove and pairs of bosses. Grooves matched with the tongue platforms are formed between the pairs of bosses. The clamp groove is buckled in the sunk groove, and the tongue platforms are arranged in the grooves and are limited by stop pins. The mechanism facilitates replacement of the clamp block, enabling an injection head to be stable in continuous work and convenient to maintain.

8 Claims, 4 Drawing Sheets

(58) Field of Classification Search
USPC ..... 226/173
See application file for complete search history.

(56) References Cited

U.S. PATENT DOCUMENTS

| | | | | |
|---|---|---|---|---|
| 6,527,055 | B1 | 3/2003 | Gipson | |
| 6,892,810 | B2 * | 5/2005 | Austbo | E21B 19/22 166/77.3 |
| 8,191,620 | B2 * | 6/2012 | Maschek, Jr. | E21B 19/22 166/77.3 |
| 2002/0046833 | A1 * | 4/2002 | Perio, Jr. | E21B 19/22 166/77.3 |
| 2010/0132935 | A1 * | 6/2010 | Magnus | E21B 19/22 166/77.3 |

* cited by examiner

CONTINUOUS OIL PIPE CLAMP MECHANISM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of oil extraction equipment, in particular to a continuous oil pipe clamp mechanism.

2. Description of Related Art Including Information Disclosed Under 37 CFR 1.97 and 37 CFR 1.98

An injection head is a key component of coiled tubing equipment, and a clamp mechanism provides clamping force for the injection head, so as to convey the continuous oil pipe. At present, on commonly used injection heads, a clamp mechanism with a rolling element is usually used, but the connection between a clamp block and a clamp block seat of the clamp mechanism has the following drawbacks: first, the clamp block and clamp block seat are inconvenient to install or replace, since screws are used for position limiting; second, the limit screws may get loose or even be fractured under the frequent shearing force incurred by the random load on the clamp block in the clamp mechanism, and consequently the stability of the clamp mechanism in continuous operation is affected; third, the free clearance of the clamp block on the clamp block seat is small owing to the existing fixing method, which is disadvantageous for self-adjustment of the clamp block when the clamp block is used to clamp an oil pipe, and consequently the clamp block may produce high impact on the oil pipe and result in severe abrasion of the oil pipe.

SUMMARY OF THE INVENTION

To overcome the above-mentioned drawbacks in the prior art, the present invention provides a continuous oil pipe clamp mechanism, which can work stably and is easy to remove and replace.

The present invention employs the following technical scheme to solve the above-mentioned technical problems: a continuous oil pipe clamp mechanism, comprising a clamp block seat and a saddle-shaped clamp block buckled on the clamp block seat.

The saddle-shaped clamp block comprises a saddle-shaped clamp portion and a bottom, wherein the bottom is provided with a clamp groove in a direction perpendicular to a clamped oil pipe, and tongue platforms are arranged at two ends of the clamp groove.

The clamp block seat comprises a fit portion in fit with the bottom of the saddle-shaped clamp block, wherein the fit portion is provided with a sunk groove matched with the clamp groove on two edges in the direction perpendicular to the clamped oil pipe, shoulder platforms are formed at two sides of the sunk groove, the fit portion is provided with a pair of bosses corresponding to the tongue platforms at two ends of the clamp block, and the boss is arranged with a stop pin hole; grooves matched with the tongue platforms are formed between the pairs of bosses.

The clamp groove is buckled in the sunk groove, the tongue platforms are arranged in the grooves, and the saddle-shaped clamp block is limited on the clamp block seat by stop pins arranged in the stop pin holes.

The beneficial effects of the present invention include: the shoulder platforms on the clamp block seat limits the length of movement of the saddle-shaped clamp block in the moving direction of the oil pipe; since the saddle-shaped clamp block is pressed on the clamp block seat by stop pins, the saddle-shaped clamp block is convenient and easy to install and replace, and is more reliable to use.

On the basis of the technical scheme described above, the present invention can be further improved as follows:

Furthermore, the length of the sunk groove is greater than that of the clamp groove, and free clearance is formed between them.

The improved scheme described above has the following beneficial effects: with appropriate free clearance arranged between the sunk groove and the clamp groove, the clamp mechanism can work normally, and the clamp block can utilize the free clearance to adjust its position automatically in case the continuous oil pipe is deformed or abraded, so that the squeeze pressure of the clamp block on the oil pipe can be reduced, and thereby rapid wear of the oil pipe can be avoided.

Furthermore, a gasket is arranged between the saddle-shaped clamp block and the clamp block seat.

The gasket has a plurality of holes.

The improved scheme described above has the following beneficial effect: the elastic gasket can effectively buffer the radial impact produced by the clamp block on the oil pipe; therefore, the wearing between the oil pipe and the clamp block can be alleviated, and the service life of the oil pipe and clamp mechanism can be prolonged.

Furthermore, the clamp block seat comprises a pin shaft and a rolling element fitted over the pin shaft; the clamp block seat is arranged with two through-holes in the direction of the pin shaft for connecting the chain of an injection head; the clamp block seat has three partitions on its upper part, and through-holes for receiving the pin shaft are arranged in the partitions.

The rolling element is a rolling bearing or rolling bushing.

The improved scheme described above has the following beneficial effect: with a rolling bearing or rolling bushing, the clamp mechanism can move more smoothly.

Furthermore, a circlip for shaft is arranged on each end of the pin shaft.

The improved scheme described above has the following beneficial effect: the rolling element can be removed and replaced quickly.

Furthermore, the saddle-shaped clamp portion of the saddle-shaped clamp block is arranged with at least two arc grooves.

The improved scheme described above has the following beneficial effect: with the arc grooves, the clamping force on the continuous oil pipe can be increased, and potential damage to the oil pipe resulted from foreign matters can be avoided.

Figure 1:
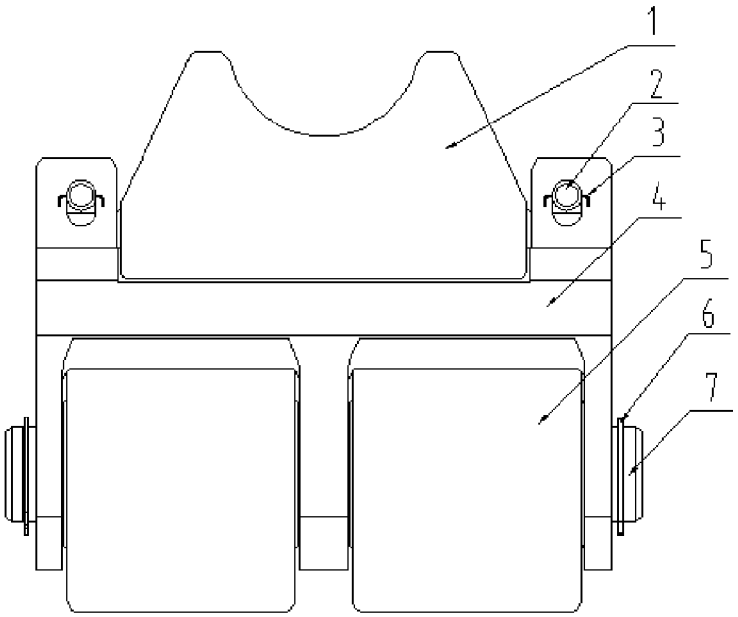
FIG. 1 is a schematic view of a structural diagram of the continuous oil pipe clamp mechanism according to the present invention.
Figure 2:
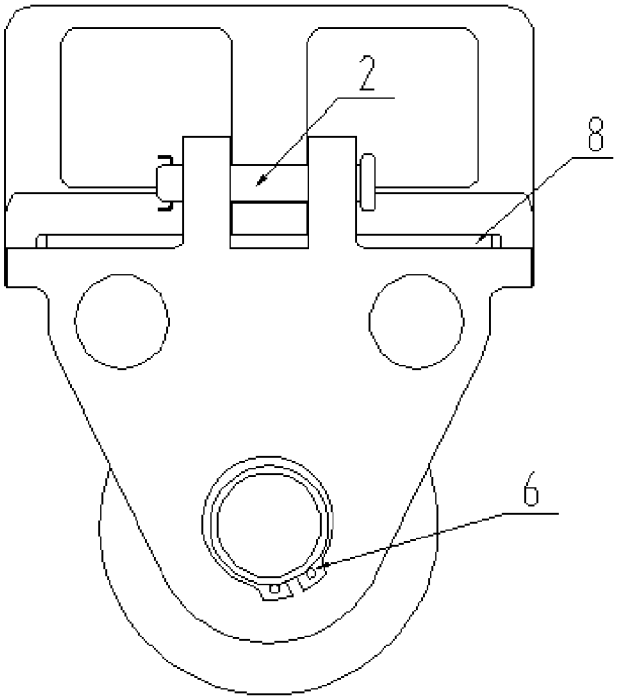
FIG. 2 is a side schematic view of the structure shown in FIG. 1.
Figure 3:
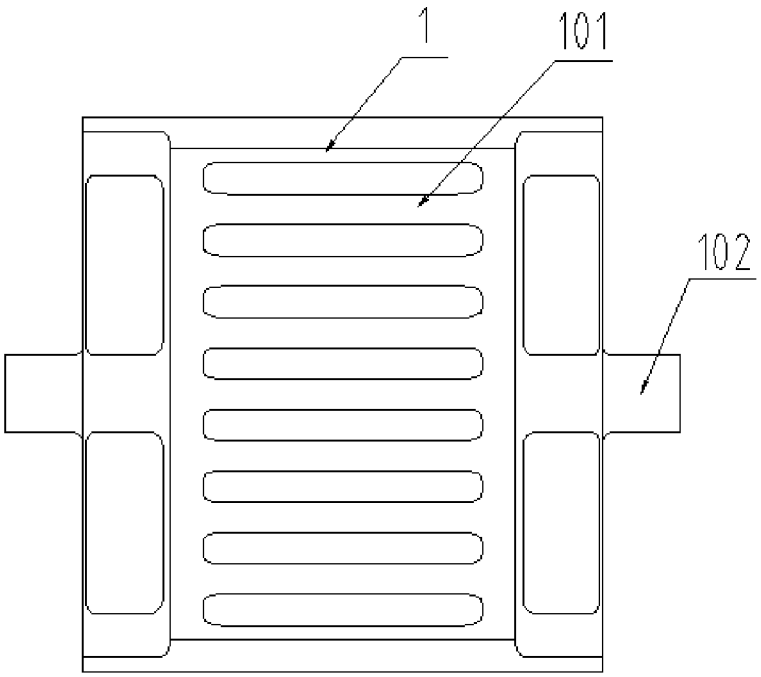
FIG. 3 is a front schematic view of the saddle-shaped clamp block of the continuous oil pipe clamp mechanism according to the present invention.
Figure 4:
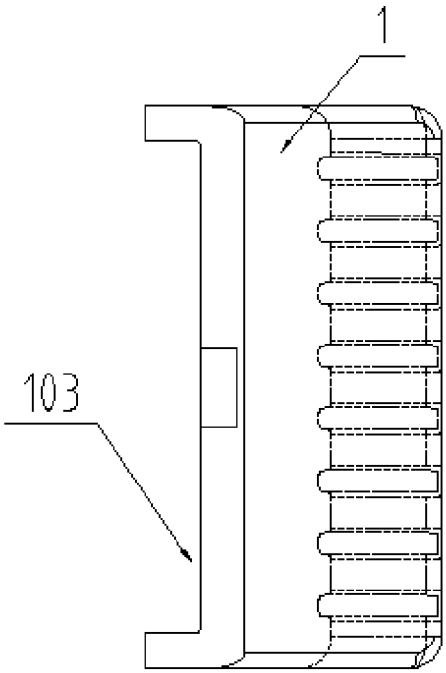
FIG. 4 is a side schematic view of the structure shown in FIG. 3.
Figure 5:
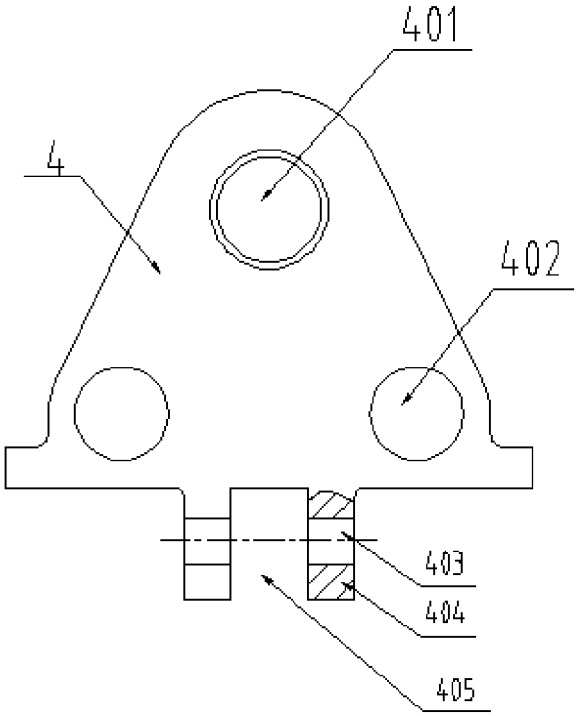
FIG. 5 is a side schematic view of the clamp block seat of the continuous oil pipe clamp mechanism (without rolling element) according to the present invention.
Figure 6:
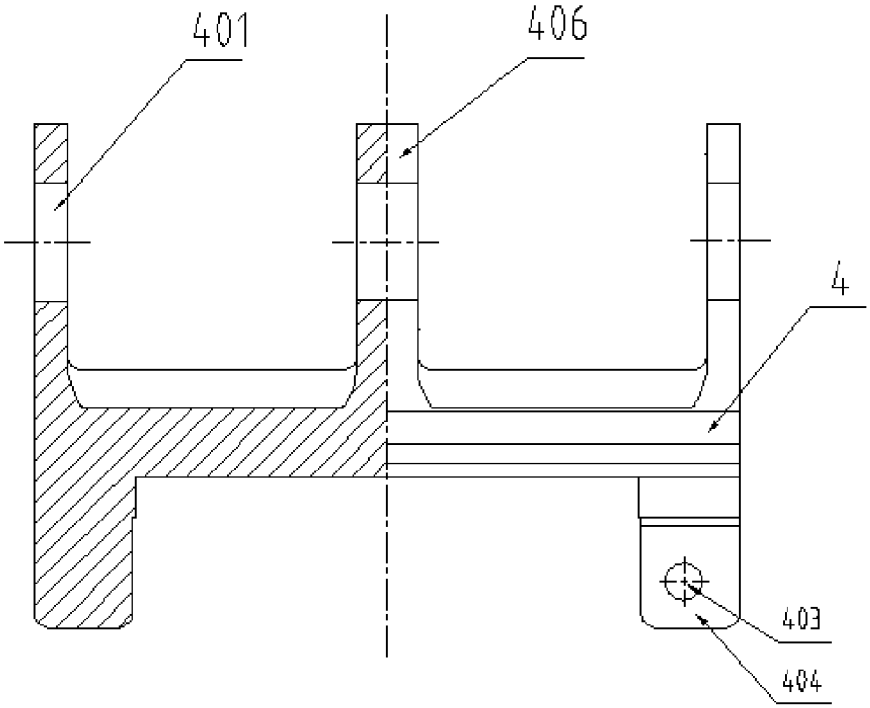
FIG. 6 is a front schematic view of the structure shown in FIG. 5.
Figure 7:
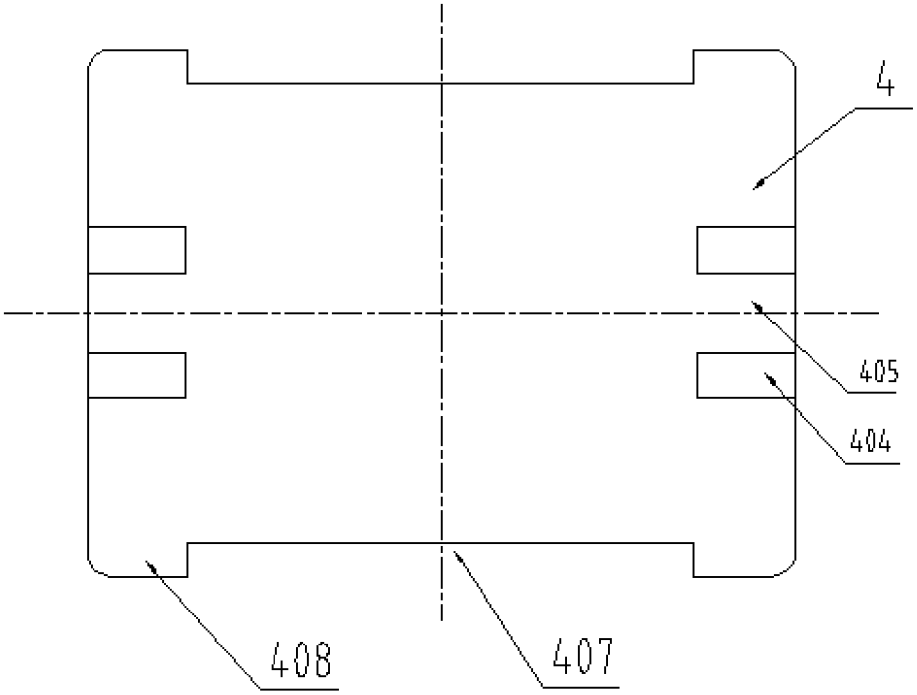
FIG. 7 is a bottom schematic view of the structure shown in FIG. 5.
Figure 8:
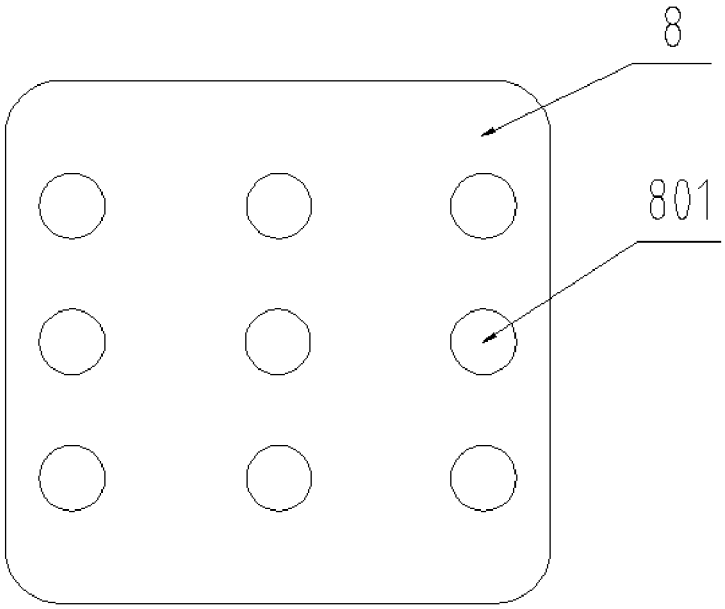
FIG. 8 is a schematic view of another structural diagram of the gasket of the continuous oil pipe clamp mechanism according to the present invention.

Among FIG. 1-FIG. 8, the components denoted by the symbols are: 1—saddle-shaped clamp block; 2—stop pin; 3—pin; 4—clamp block seat; 5—rolling element; 6—circlip for shaft; 7—pin shaft; 101—arc groove; 102—tongue platform; 103—clamp groove; 401—pin shaft hole; 402—through-hole; 403—stop pin hole; 404—boss; 405—groove; 406—partition; 407—sunk groove; 408—shoulder platform; 8—gasket; 801—hole.

DETAILED DESCRIPTION OF THE DRAWINGS

Hereunder the principle and characteristics of the present invention will be detailed with reference to the accompanying drawings. However, it should be noted that the embodiments are provided only to interpret the present invention but don't constitute any limitation to the scope of the present invention.

As shown in FIG. 1-FIG. 8, the present invention provides a continuous oil pipe clamp mechanism, comprising a saddle-shaped clamp block 1 and a clamp block seat 4, wherein the saddle-shaped clamp block 1 is buckled on the clamp block seat 4, the saddle-shaped clamp block 1 comprises a saddle-shaped clamp portion and a bottom, wherein the bottom is provided with a clamp groove 103 in a direction perpendicular to the clamped oil pipe, and tongue platforms 102 are arranged at two ends of the clamp groove.

The clamp block seat 4 comprises a fit portion in fit with the bottom of the saddle-shaped clamp block 1, wherein the fit portion is provided with a sunk groove 407 matched with the clamp groove 103 on two edges in the direction perpendicular to the clamped oil pipe, shoulder platforms 408 are formed at two sides of the sunk groove 407, the fit portion is provided with a pair of bosses 404 corresponding to the tongue platforms 102 at two ends of the clamp block, and the boss 404 is arranged with a stop pin hole 403; grooves 405 matched with the tongue platforms 102 are formed between the pairs of bosses 404.

The clamp groove 103 is buckled in the sunk groove 407, the tongue platforms 102 are arranged in the grooves 405, and the saddle-shaped clamp block 1 is limited on the clamp block seat 4 by stop pins 2 arranged in the stop pin holes 403; pins 3 are arranged on two ends of the stop pin 2, to prevent the stop pin 2 from sliding off.

The length of the sunk groove 407 is greater than that of the clamp groove 103, and free clearance is formed between them.

A gasket 8 is arranged between the saddle-shaped clamp block 1 and the clamp block seat 4.

The gasket 8 has a plurality of holes 801.

The clamp block seat 4 comprises a pin shaft 7 and a rolling element 5 fitted over the pin shaft 7; the clamp block seat is arranged with two through-holes 402 in the direction of the pin shaft 7 for connecting the chain of an injection head; the main body of the clamp block seat has three partitions 406 on its upper part, and pin shaft holes 401 for receiving the pin shaft 7 are arranged in the partitions 406.

The rolling element 5 is a rolling bearing or rolling bushing.

A circlip for shaft 6 is arranged on each end of the pin shaft 7.

The saddle-shaped clamp portion of the saddle-shaped clamp block 1 is arranged with at least two arc grooves 101.

While the present invention is described above in some preferred embodiments, the present invention is not limited to those preferred embodiments. Any modification, equivalent replacement, and improvement made without departing from the spirit and principle of the present invention shall be deemed as falling into the protected domain of the present invention.

We claim:

1. A continuous oil pipe clamp mechanism, comprising:

a clamp block seat; and a saddle-shaped clamp block buckled on the clamp block seat, wherein said saddle-shaped clamp block comprises a saddle-shaped clamp portion and a bottom, wherein the bottom is provided with a clamp groove in a direction perpendicular to a clamped oil pipe, and wherein tongue platforms are arranged at two ends of the clamp groove wherein said clamp block seat comprises a fit portion in fit with said bottom of said saddle-shaped clamp block, wherein said fit portion is provided with a sunk groove matched with said clamp groove on two edges in said direction perpendicular to said clamped oil pipe, wherein shoulder platforms are formed at two sides of said sunk groove, wherein said fit portion is provided with a pair of bosses corresponding to said tongue platforms at two ends of said clamp block, wherein said boss is arranged with a stop pin hole, wherein grooves matched with said tongue platforms are formed between pairs of bosses, wherein said clamp groove is buckled in said sunk groove, said tongue platforms being arranged in the grooves, and wherein said saddle-shaped clamp block is limited on said clamp block seat by stop pins arranged in said stop pin holes.

2. The continuous oil pipe clamp mechanism according to claim 1, wherein said sunk groove has a length greater than a length of said clamp groove, free clearance being formed between said sunk groove and said clamp groove.

3. The continuous oil pipe clamp mechanism according to claim 1, further comprising: a gasket arranged between said saddle-shaped clamp block and said clamp block seat.

4. The continuous oil pipe clamp mechanism according to claim 3, wherein said gasket has a plurality of holes.

5. The continuous oil pipe clamp mechanism according to claim 3, wherein said clamp block seat further comprises a pin shaft and a rolling element fitted over said pin shaft, wherein said clamp block seat is arranged with two through-holes connecting a chain of an injection head in a direction of said pin shaft, wherein said clamp block seat is arranged with three partitions on an upper part thereof, and wherein said pin shaft holes receiving said pin shaft are arranged in the partitions.

6. The continuous oil pipe clamp mechanism according to claim 5, wherein said rolling element is comprised of at least one of a group consisting of: a rolling bearing and a rolling bushing.

7. The continuous oil pipe clamp mechanism according to claim 6, wherein said pin shaft is provided with a circlip for a shaft on each end of said pin shaft.

8. The continuous oil pipe clamp mechanism according to claim 1, wherein said saddle-shaped clamp portion of said saddle-shaped clamp block is arranged with at least two arc grooves.

* * * * *